US007380614B1

(12) United States Patent
Williamson et al.

(10) Patent No.: US 7,380,614 B1
(45) Date of Patent: Jun. 3, 2008

(54) REMOTELY OPERATED WATER BOTTOM BASED DRILLING SYSTEM USING CABLE FOR AUXILIARY OPERATIONS

(75) Inventors: Michael E Williamson, Seattle, WA (US); Timothy McGinnis, Seattle, WA (US); Herbert Thatcher, Kingston, WA (US); Larry Robinson, Bellevue, WA (US)

(73) Assignee: Williamson & Associates, Inc., Seattle, WA (US)

( * ) Notice: Subject to any disclaimer, the term of this patent is extended or adjusted under 35 U.S.C. 154(b) by 0 days.

(21) Appl. No.: 11/747,244

(22) Filed: May 11, 2007

(51) Int. Cl.
*E21B 7/124* (2006.01)

(52) U.S. Cl. ..... 175/6; 175/244

(58) Field of Classification Search ..... 175/5, 175/6, 58, 246, 244
See application file for complete search history.

(56) References Cited

U.S. PATENT DOCUMENTS

| | | | | |
|---|---|---|---|---|
| 2,937,006 | A * | 5/1960 | Thayer | 175/6 |
| 3,279,547 | A * | 10/1966 | Berne et al. | 175/6 |
| 3,670,830 | A * | 6/1972 | Van Der Wijden | 175/52 |
| 3,741,320 | A * | 6/1973 | Hilfing | 175/6 |
| 4,043,407 | A * | 8/1977 | Wilkins | 175/50 |
| 4,249,619 | A * | 2/1981 | Burns | 175/9 |
| 4,255,068 | A * | 3/1981 | Valantin | 405/195.1 |
| 2006/0016621 | A1* | 1/2006 | Jackson et al. | 175/7 |
| 2007/0119622 | A1* | 5/2007 | Ayling | 175/5 |

OTHER PUBLICATIONS

Sager, W. et al., Requirements for Robotic Underwater Drills in U.S. Marine Geologic Research, proposal to Texas A&M University by University of Washington, Nov. 3-4, 2000.

* cited by examiner

*Primary Examiner*—Jennifer H Gay
*Assistant Examiner*—Daniel P Stephenson
(74) *Attorney, Agent, or Firm*—Richard A. Fagin

(57) ABSTRACT

A method for drilling formations below the bottom of a body of water includes disposing a drilling system on the bottom of the body of water. The formations are drilled by rotating a first drill rod having a first core barrel latched therein and advancing the drill rod longitudinally. At a selected longitudinal position, an upper end of the first drill rod is opened and a cable having a latching device at an end thereof is lowered into the first drill rod. The winch is retracted to retrieve the first core barrel. The first core barrel is laterally displaced from the first drill rod. A second core barrel is inserted into the first drill rod and latched therein. A second drill rod is affixed to the upper end of the first drill rod. Drilling the formation is then resumed by longitudinally advancing and rotating the first and second drill rods.

8 Claims, 5 Drawing Sheets

REMOTELY OPERATED WATER BOTTOM BASED DRILLING SYSTEM USING CABLE FOR AUXILIARY OPERATIONS

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND OF THE INVENTION

1. Field of the Invention

The invention relates generally to the field of drilling Earth formations below the bottom of a body of water. More specifically, the invention relates to remotely operated drilling devices that are positioned on the sea floor.

2. Background Art

Drilling through Earth formations located below the bottom of a body of water generally require the use of drilling equipment deployed from a barge or ship, and in the case of deep water sites, from a drillship or semisubmersible floating drilling platform. Such drilling is a complicated and expensive operation, particularly in deep water where a drilling riser must be extended from the floating drilling structure to the sea floor to provide a return conduit for drilling fluid from the well as it is drilled. In addition to cost, drilling using such riser is not well suited to drilling tasks requiring precise control of bit weight, stability (motion compensation) of the drill string and exact positioning of tools within the borehole. Positioning of the surface vessel over the borehole on the seabed is of critical importance when a drilling riser is used. Multiple anchors or dynamic positioning are required to maintained the required degree of positional stability of the floating drilling platform. The in-water weight of the riser limits the water depth in which risers can be deployed. Floating drilling platforms capable of handling long risers for deep water are by necessity very large vessels.

In an attempt to minimize the above noted aspects of drilling in deep water, several seafloor based drilling systems have been developed and are in current operation. "BMS #1" and "BMS #2" are owned by JOGMEC (Japan), "PROD" is owned by Benthic Geotech Pty. Ltd. (Australia), "MeBo" is owned by the University of Bremen (Germany) and "RD2" is owned by the British Geologic Survey. The forgoing remotely operated systems have proven effective in drilling into the seabed, particularly in deep water. Because they all use a flexible umbilical rather than a drilling riser, the in-water weight of such systems is typically less than 20 tons and as a result drilling operations can be conducted from vessels as small as 50 m in length. Station keeping (positional stability) requirements for the vessel are much less stringent than for floating drilling platforms using riser, and an operational watch circle of about 20% of the water depth is adequate in most cases. Because the drilling systems are disposed on the water bottom while drilling and are necessarily heavy enough to provide sufficient reactive mass to advance the drill string, the stability of tools disposed within the borehole is excellent. Complete decoupling of drill string motion from ship motion is accomplished.

When used to drill core samples of the subsurface below the bottom of a body of water, all of such remotely operated water bottom drilling systems depend upon rod coring methodology. A core barrel is disposed at the bottom of a drill string. The core barrel is typically about the same length as one segment of drill pipe or string. As the borehole is extended by drilling, the core barrel is filled and then must be retrieved from the borehole to extract the core therein. Such methodology requires the retrieval of the entire drill string each time a core barrel is recovered. While the foregoing method operated from a water bottom disposed drilling unit eliminates the drill pipe riser extending from the floating drilling platform to the water bottom, the extensive tool handling required by such coring techniques results in a significant operational time to complete boreholes deeper than about 30 meters. A single 100 meter deep borehole using rod coring with standard 3 meter core barrels and drill rods requires more than two thousand tool handling operations and over one hundred hours complete. The extensive time on station and the large number of tool manipulations make rod core drilling impractical for all but shallow holes in deep water.

There exists a need for a water bottom based drilling unit that can obtain core samples with reduced tool handling an operating time.

SUMMARY OF THE INVENTION

A water bottom drilling system according to one aspect of the invention includes a frame configured to rest on the bottom of a body of water. A support structure is movably coupled to the frame. The support structure is configured to enable at least vertical movement of a drill head mounted on the support structure. A winch is movably coupled to the support structure and configured to enable lateral movement of the winch mounted on the support structure. The winch includes a cable thereon. An end of the cable includes a latching device thereon configured to latch onto an upper end of a core barrel disposed in the lower end of a drill string. A storage area is associated with the frame for drill rods and for core barrels. The core barrels each include a latch configured to releasably engage with a lowermost drill rod on a drill string. Each core barrel includes a latch configured to engage the latching device at the end of the cable. At least one clamp is associated with the frame and is arranged to fix a vertical position of a drill string over a drill hole.

A method for drilling formations below the bottom of a body of water includes disposing a drilling system on the bottom of the body of water. The formations are drilled by rotating a first drill rod having a first core barrel latched therein and advancing the drill rod longitudinally. At a selected longitudinal position, an upper end of the first drill rod is opened and a cable having a latching device at an end thereof is lowered into the first drill rod. The winch is retracted to retrieve the first core barrel. The first core barrel is laterally displaced from the first drill rod. A second core barrel is inserted into the first drill rod and latched therein. A second drill rod is affixed to the upper end of the first drill rod. Drilling the formation is then resumed by longitudinally advancing and rotating the first and second drill rods. The above procedure may be repeated by opening the upper end of the uppermost drill rod, retrieving the core barrel using the winch, displacing the retrieved core barrel, inserting a new core barrel in the drill string until it latches in the first drill rod, affixing a new drill rod to the upper end of the drill string, and resuming drilling.

Other aspects and advantages of the invention will be apparent from the following description and the appended claims.

DETAILED DESCRIPTION

Figure 1:
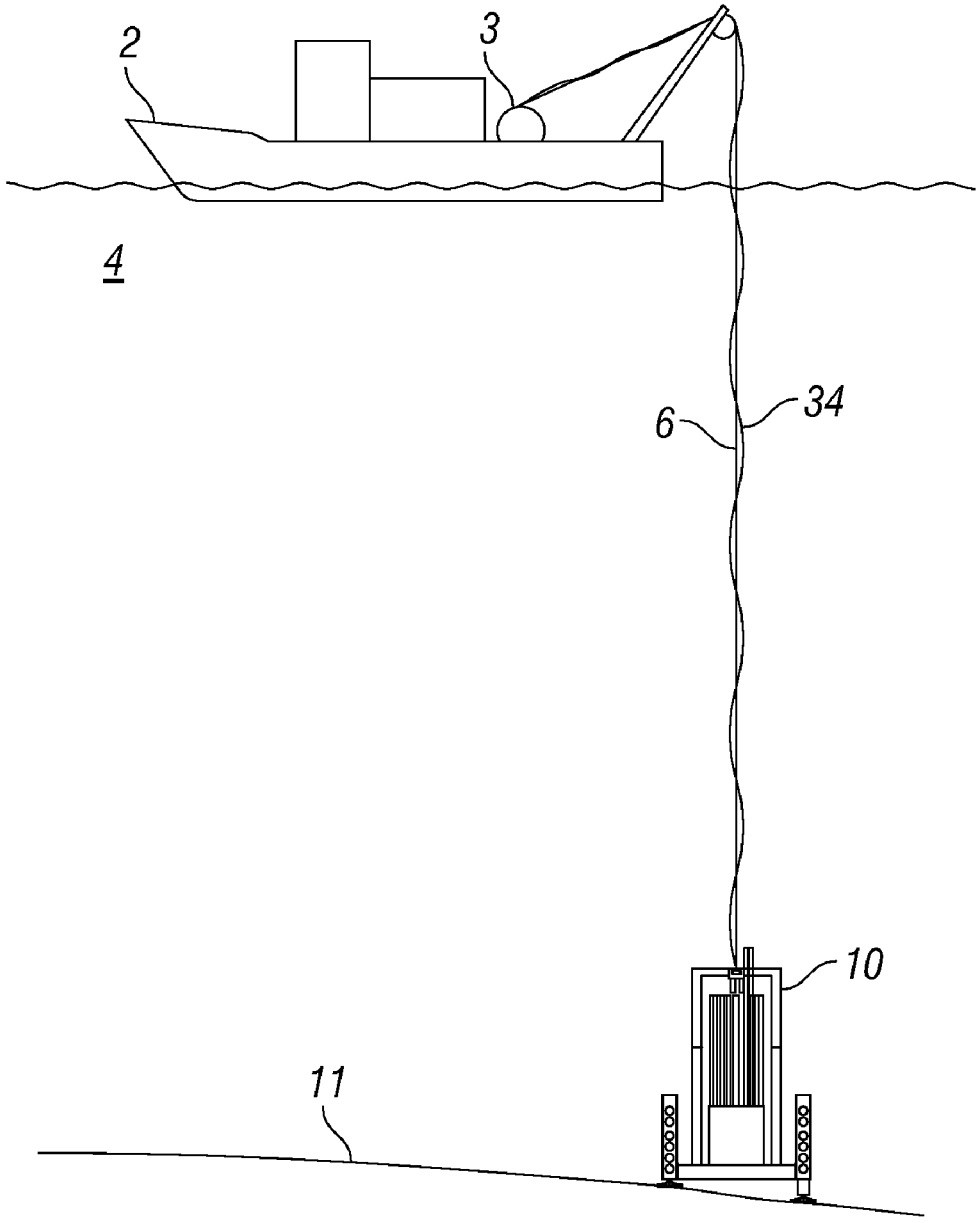
FIG. 1 shows a ship deploying a drilling system on the bottom of a body of water.

FIG. 1 shows a ship or vessel 2 having a winch 3 or similar spooling device thereon on the surface of a body of water 4 such as the ocean. The winch 3 can spool and unspool a deployment cable 6 and an umbilical cable 34 used to deploy a drilling system 10 on the bottom 11 of the body of water. The deployment cable 6 may nor may not be part of the same physical cable as the umbilical cable 34. A water bottom based drilling system 10 is deployed using the cable 6 and is caused to rest on the bottom 11 of the body of water. After drilling operations are completed, the system 10 may be retrieved and returned to the vessel 2.

Figure 2:
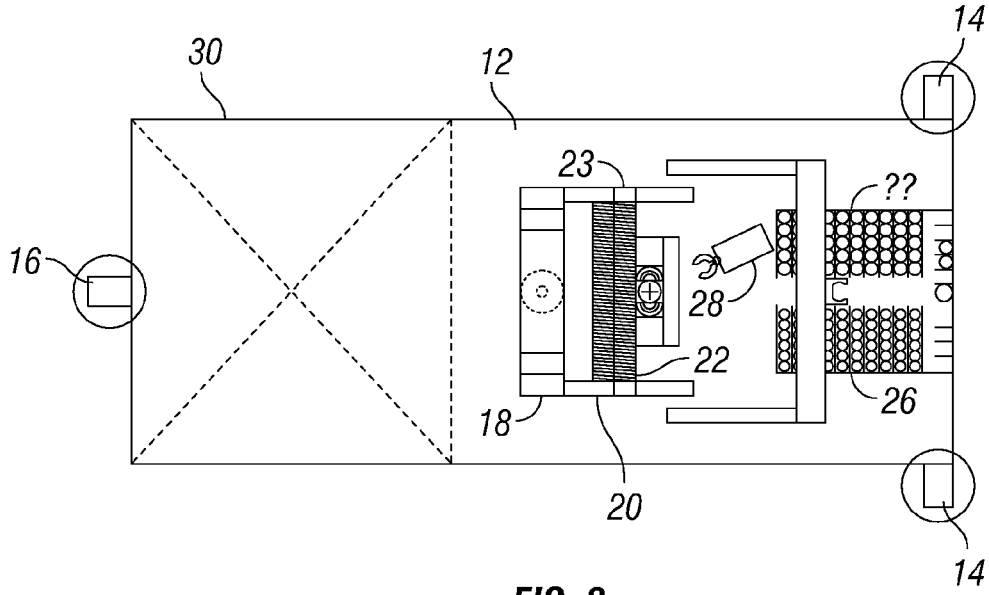
FIG. 2 shows a plan view of an example drilling system according to the invention.

A plan view of an example drilling system is shown in FIG. 2. The system 10 is mounted on a frame 12 that provides support for the various components of the system 10. The frame 12 may have support legs 14 disposed on two corners to maintain the frame 12 in suitable orientation when the system 10 is disposed on the bottom of a body of water. An adjustable height leveling leg 16 may be disposed on the opposite side of the frame. Alternatively, all the legs 14, 16 may be adjustable height. An electrical and hydraulic power unit 30 may accept electrical and/or hydraulic power through the umbilical cable (34 in FIG. 1) that extends from the system 10 to the vessel (2 in FIG. 1) on the water surface. The frame 12 may include one or more features used to lower the system 10 through the water using the winch (3 in FIG. 1) or similar device deployed on the vessel (2 in FIG. 1). Deployment of the system can be similar to that using water bottom deployed drilling systems known in the art, and the manner of deployment of the system 10 is not intended to limit the scope of the invention. Electrical and/or hydraulic power supplied by and through the power unit 30 may operate the various devices disposed on the frame 12 as will be further explained below. The power unit 30 may include a fluid pump (not shown separately) to circulate flushing fluid for drilling operations.

The frame 12 may include a drill head support structure 18. Such structure may include devices for vertically raising and lowering a drill head (32 in FIG. 3) and for moving the drill head laterally along the frame 12 so that the drill head may be coupled to a drill string, and may be moved out of the way of the drill string so that certain operations described below may be performed on and within the drill string.

The frame 12 also supports a wireline winch 20. The winch may include a selected length of armored cable 22 thereon (see also 22A in FIG. 5D). The cable may or may not have one or more insulated electrical conductors therein. The cable 22 may also be slickline, wire rope or synthetic fiber line. The purpose for the winch 20 and cable 22 will be further explained below with reference to FIGS. 5A through 5H. The winch 20 may be mounted on a support structure 23 that enables the winch 20 to be moved laterally along the frame. Either or both support structures 18, 23 may include devices such as hydraulic rams (not shown) to enable lateral movement of the drilling head and the winch, respectively. Other examples of devices to provide lateral movement capability may include a toothed rack and motor driven spur gear. The particular implementation used to laterally move either support structure 18, 23 is not intended to limit the scope of the invention.

The frame 12 may also include storage area for drill rods 24 and for core barrels 26, respectively. A tool handling gantry 28 may be coupled to the frame 12 and arranged to remove drill rods (see 60 in FIG. 5A) from the storage area 24 or to replace drill rods in the storage area 24. The tool handling gantry 28 may also be arranged to move core barrels (see 62 in FIG. 5A) to and from the storage area. Typically the tool handing gantry 28 will move the drill rods or core barrels so that they can be retained by jaws or grippers on a tool handling arm (44 in FIG. 3) that grabs the respective core barrel or drill rod from its outer surface so that the interior of the respective core barrel or drill rod is accessible.

Figure 3:
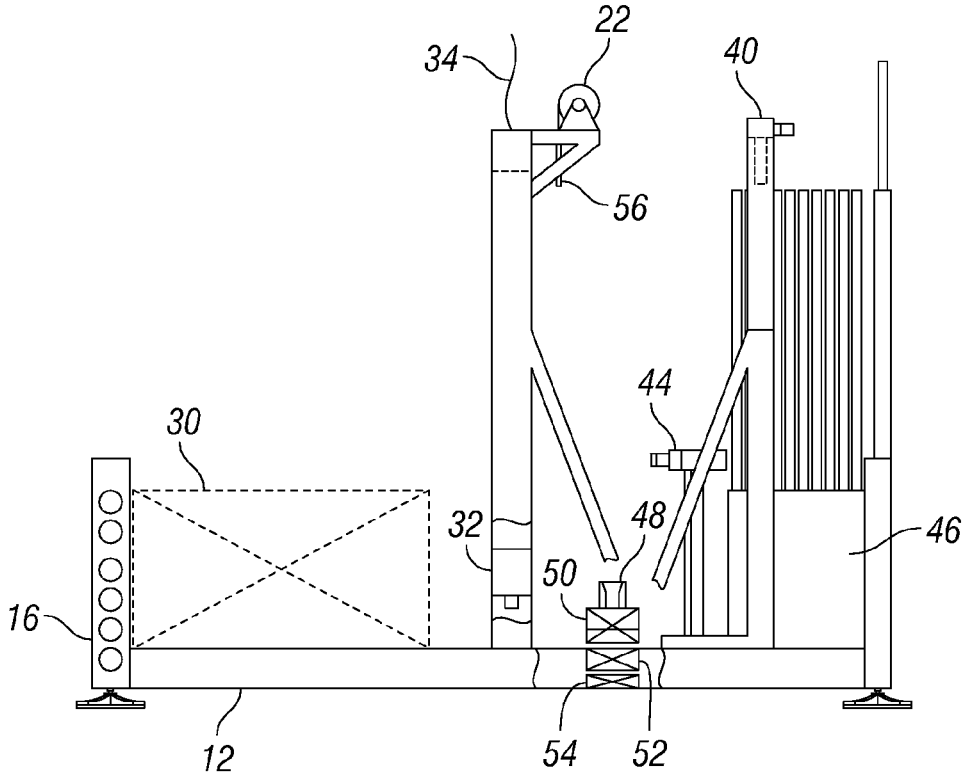
FIG. 3 shows a side view of the drilling system shown in FIG. 2.

A side view of the system 10 is shown in FIG. 3. A drill head 32 is shown in its rest position to enable operations within the interior of the drill string. The lower portion of the frame 12 supports an alignment clamp 48, upper foot clamp 50, lower foot clamp 52 and casing clamp 54. The various clamps are used to lock in place elements of the drill string as additional drill rods are added thereto or removed therefrom. The tool handing gantry (28 in FIG. 1) may also include a grabber 42 for oversized drilling tools. The tool handing gantry 28 may also include a handling arm and jaw 44 as explained above. Drilling tools may be stored in a respective tool magazine 46.

Figure 4:
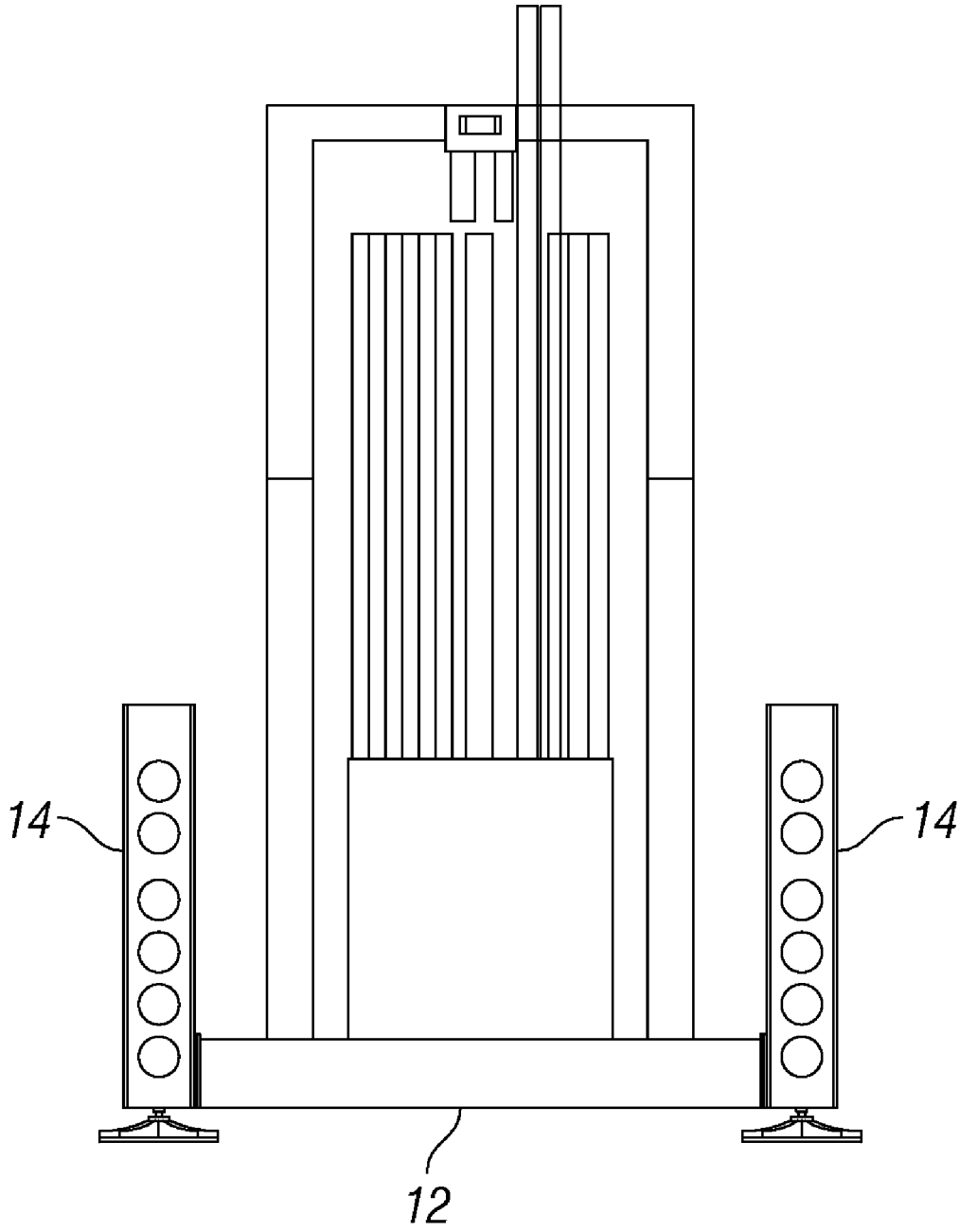
FIG. 4 shows an end view of the drilling system shown in FIG. 2.

An end view of the system is shown in FIG. 4.

Having explained the principal components of a water bottom disposed drilling system, a method of operating such system will now be explained with reference to FIGS. 5A through 5H. First referring to FIG. 5A, at the start of drilling operations, an assembly of a drill rod 60 and core barrel 62 latched inside the drill rod 60 is coupled to the drill head 32 and is suspended above the water bottom 11. In some implementations the drill head 32 may include an hydraulically operated motor or electric motor (neither shown separately) to cause rotation of the drill rod 60. The drill head 32 may also include an hydraulic swivel (not shown) to enable pumping of flush fluid through the interior of the drill rod 60 during drilling operations and in particular while the drill rod 60 is being rotated. Other implementations may include a means for rotating the drill rod 60 coupled to the frame proximate one or more of the clamps (see FIG. 3). The manner of rotating the drill rod 60 is left to the discretion of the system designer and is not intended to limit the scope of the invention. An annular opening core bit 63 may be disposed at the bottom of the drill rod 60 to drill the subsurface formations while enabling a substantially cylindrical core of such formations to be moved into the interior of the core barrel 62 as the drill string advances downwardly below the water bottom 11. The beginning of such drilling a borehole 13 using the first assembly of drill rod 60 and core barrel is shown in FIG. 5B.

Figures 5A, 5B, 5C, 5D, 5E, 5F, 5G, 5H:
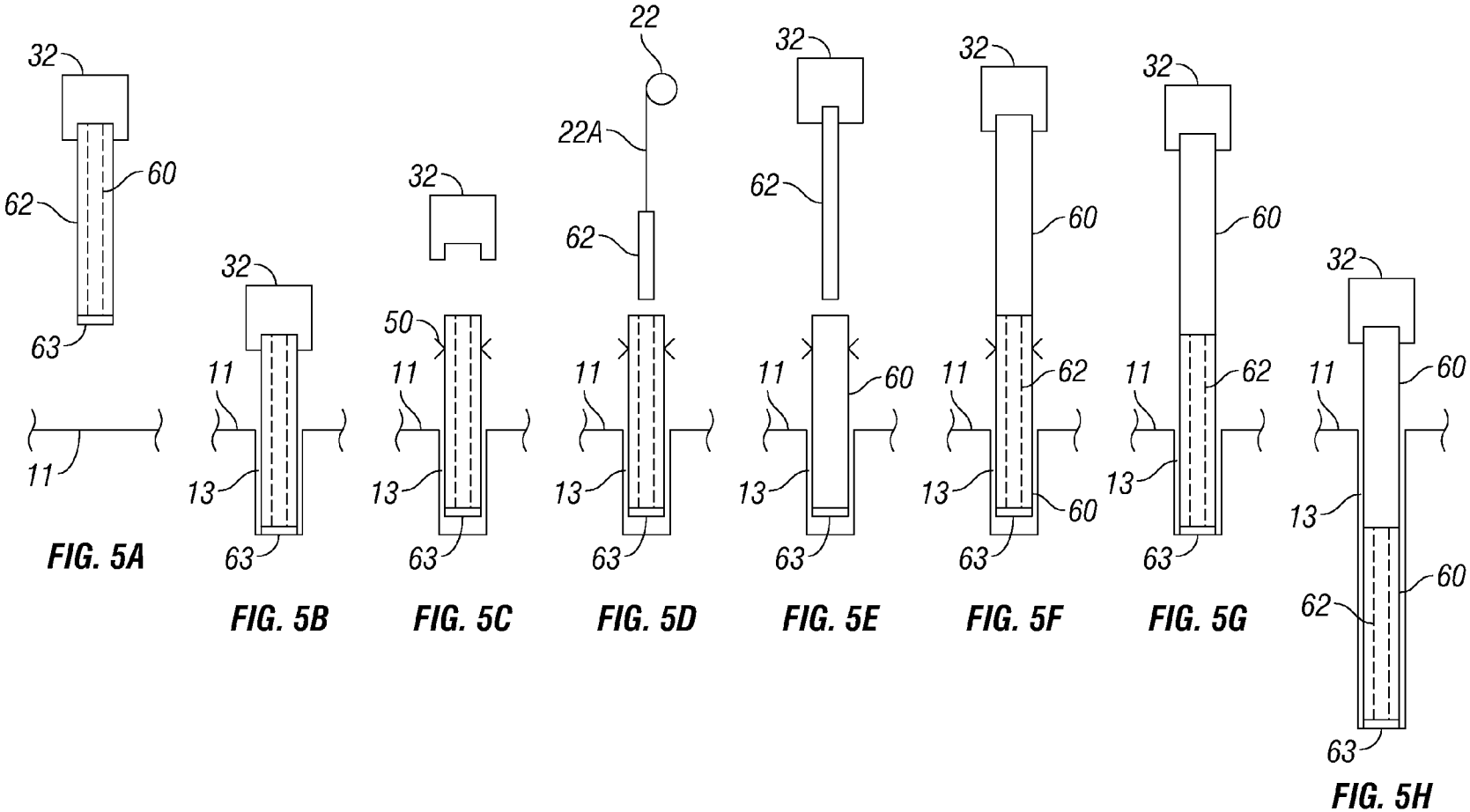
FIGS. 5A through 5H show one example of a drilling method according to the invention.

In FIG. 5C, the borehole 13 is drilled such that the first drill rod is moved to the lowermost possible position within the drilling system, and to continue extending the borehole 13 would require lengthening the drill string by coupling to an upper end thereof an additional drill rod 60. In FIG. 5C, the drill string is raised so that the drill rod 60 may be securely locked in the foot clamp 50. The drill head 32 may then be removed from the upper end of the drill rod 60. Such removal may be performed by rotationally locking the drill rod and counter rotating the drill head 32, or by rotationally locking the drill head 32 and rotating the drill rod 60 using a breakout device (not shown) in the foot clamp 50. Alternatively, the drill head 32 may include a top drive having an hydraulic chuck. The manner of making and breaking connections between the drill head 32 and the drill rods 60 and between adjacent interconnected drill rods 60 is not intended to limit the scope of the invention. After the drill head 32 is uncoupled from the drill rod 60, the drill head 32 may be laterally repositioned using, for example, the device shown at 18 in FIG. 1. Laterally repositioning the drill head 32 enables moving devices inside the drill rod 60 and/or coupling additional drill rods to the drill rod 60 partially disposed in the borehole 13. When one or more additional drill rods are coupled to the drill rod 60 disposed in the borehole 13, the assembly is referred to as a "drill string." As an alternative to lateral repositioning, the drill head 32 may be moved longitudinally to a height above the upper end of the drill rod 60 sufficient to enable moving the winch over the drill rod to provide access by cable 20 to the interior of the drill rod 60.

In FIG. 5D, the winch 22 is laterally repositioned such that an end of the cable 22A is disposed directly above the drill rod 60 locked in the foot clamp 50. The winch 22 is then operated such that an overshot 56 of any type known in the art is lowered into the interior of the drill rod 60 and is then latched to a mating feature (FIG. 6) in the upper end of the core barrel 62. The core barrel 62 may then be removed from the interior of the drill rod 60 by unlatching by the action of the overshot 56. The winch 22 may then be laterally repositioned such that the core barrel 62 previously retrieved from the inside of the drill rod 60 may be grabbed by the tool arm (44 in FIG. 3) and moved to be stored in the storage area (26 in FIG. 1).

In FIG. 5E, another core barrel 62 may be retrieved from the storage area (26 in FIG. 2) and coupled to the drill head 32. Such coupling may be performed by using the tool handling device (28 in FIG. 2) to hold the core barrel in a lateral position above the drill rod 60 still in the borehole 13 and latching the drill head 32 to the upper end thereof. The drill head 32 may then be lowered such that the new core barrel 62 is inside the drill rod 60. The new core barrel 62 may then be pumped to the bottom of the drill rod 60 and latched into position in the drill rod 60.

In FIG. 5F, an additional drill rod 60 may be coupled to the drill head 32, and the drill head 32 lowered so that the additional drill rod 60 is affixed to the drill rod 60 still locked in the foot clamp 50. The foot clamp 50 may then be released, and as shown in FIG. 5G, drilling may resume by rotating and longitudinally advancing the drill string. Drilling continues typically until the uppermost drill rod reaches the lowest possible position in the system, as shown in FIG. 5H. At such time, the procedure explained with reference to FIGS. 5C through 5F can be repeated, and drilling may continue for each successive additional drill rod coupled to the drill string until the borehole 13 is extended to the intended depth.

By retrieving core barrels 62 from the lowermost drill rod 60 using the wireline overshot 56 as explained above, successive core samples may be withdrawn from the borehole 13 without the need to retrieve the entire drill string each time a core barrel is retrieved. Such capability substantially reduces the number of tool operations and amount of time needed to drill a borehole below the bottom of a body of water.

Figure 6:
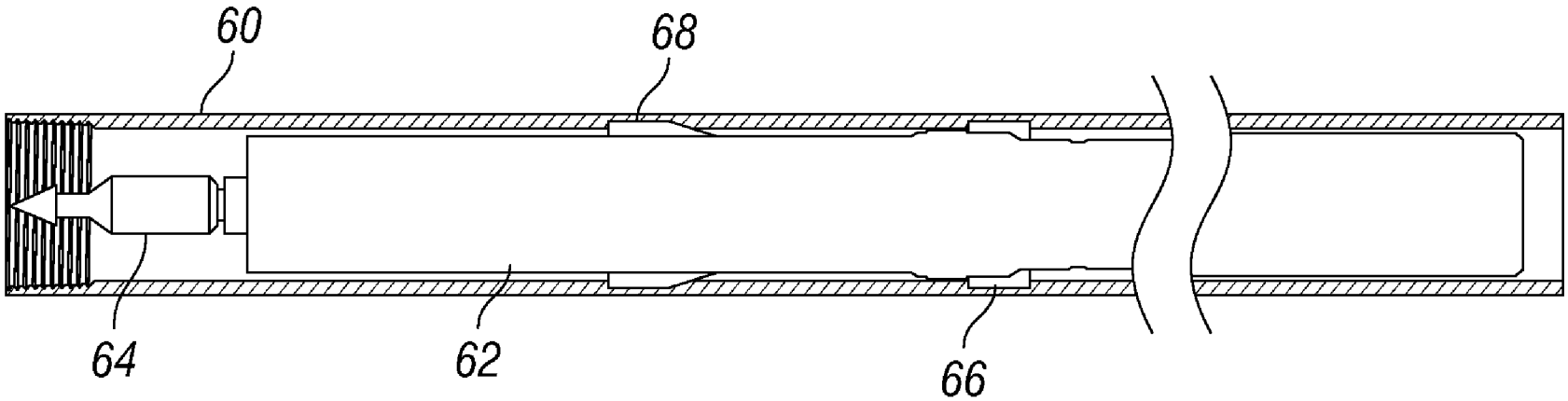
FIG. 6 shows a cut away view of a core barrel latched inside a drill rod.

A cut away view of a drill rod 60 having a core barrel 62 therein is shown in FIG. 6. The core barrel 62 may include a fishing neck 64 configured to engage the overshot (56 in FIG. 2). The core barrel 62 may include a latch 68 that can be released by the upward force exerted by the cable (22 in FIG. 1) when the core barrel 62 is to be retrieved from the drill rod 60. A shoulder 66 inside the drill rod 60 may provide a seat to retain the core barrel 62 when it is pumped into the drill rod 60.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A water bottom drilling system, comprising:

a frame configured to rest on the bottom of a body of water;

a support structure movably coupled to the frame, the support structure configured to enable at least vertical movement of a drill head mounted on the support structure;

a winch movably coupled to the support structure and configured to enable lateral movement of the winch mounted on the support structure, the winch including a cable thereon, an end of the cable including a latching device thereon configured to latch onto an upper end of a core barrel disposed in the lower end of a drill string;

a storage area associated with the frame for drill rods and for core barrels, wherein the core barrels each include a latch configured to releasably engage with a lowermost drill rod on a drill string, and wherein each core barrel include a latch configured to engage the latching device at the end of the cable; and at least one clamp associated with the frame and arranged to fix a vertical position of a drill string over a drill hole.

2. The system of claim 1 wherein the support structure is configured to enable vertical and lateral movement of the drill head.

3. The system of claim 1 wherein the cable comprises one of armored cable, wire rope and synthetic fiber rope.

4. A method for drilling formations below the bottom of a body of water, comprising:

disposing a drilling system on the bottom of the body of water;

drilling the formations by rotating a first drill rod having a first core barrel latched therein and advancing the drill rod longitudinally;

at a selected longitudinal position, opening an upper end of the first drill rod and lowering a cable having a latching device at an end thereof into the first drill rod, the opening the upper end of the first drill rod including removing a drill head therefrom;

retracting the cable to retrieve the first core barrel;

laterally displacing the first core barrel from the first drill rod;

inserting a second core barrel into the first drill rod and latching it therein;

affixing a second drill rod to the upper end of the first drill rod; and resuming drilling the formation by longitudinally advancing and rotating the first and second drill rods.

5. The method of claim 4 further comprising:

at a selected longitudinal position, opening an upper end of the second drill rod and lowering the cable having the latching device at the end thereof into the second and first drill rods;

retracting the cable to retrieve the second core barrel;

laterally displacing the second core barrel from the first and second drill rods;

inserting a third core barrel into the first and second drill rods and latching them in the first drill rod;

affixing a third drill rod to the upper end of the second drill rod; and resuming drilling the formation be longitudinally advancing and rotating the first, second and third drill rods.

6. The method of claim 4 wherein the rotating comprises operating a motor in the drill head coupled to the first drill rod.

7. The method of claim 4 wherein the removing the drill head further comprises displacing the drill head at least one of vertically and laterally a sufficient amount to enable access to the interior of the first drill rod by the cable.

8. The method of claim 4 further comprising lifting the first drill rod from a bottom of a borehole created by drilling, and affixing a vertical position of the first drill rod prior to opening an upper end thereof.

* * * * *